United States Patent [19]

Andrejkovics

[11] 4,004,521

[45] Jan. 25, 1977

[54] PROJECTILE FUZE

[75] Inventor: Richard S. Andrejkovics, Philadelphia, Pa.

[73] Assignee: The United States of America as represented by the Secretary of the Army, Washington, D.C.

[22] Filed: Apr. 1, 1976

[21] Appl. No.: 672,581

[52] U.S. Cl. ..... 102/80; 102/74

[51] Int. Cl.[2] ..... F42C 1/04; F42C 9/16

[58] Field of Search ..... 102/80, 79, 74, 70 R

[56] References Cited

UNITED STATES PATENTS

| | | | |
|---|---|---|---|
| 3,326,132 | 6/1967 | Tlam | 102/80 |
| 3,397,640 | 8/1968 | Ziemba et al. | 102/79 X |
| 3,608,494 | 9/1971 | Ziemba | 102/79 |
| 3,949,675 | 4/1976 | Luke | 102/80 |

*Primary Examiner*—David H. Brown
*Attorney, Agent, or Firm*—Nathan Edelberg

[57] ABSTRACT

A graze sensitive and self destruct fuze arrangement for a point detonating spin stabilized projectile in which assured detonation is achieved by nose or point impact with a target, by graze impact with a target, or by self destruction capability upon failure to strike a target in either of the foregoing ways.

3 Claims, 3 Drawing Figures

PROJECTILE FUZE

The invention described herein may be manufactured, used and licensed by or for the Government for governmental purposes without the payment to me of any royalty thereon.

This invention relates to projectile fuzes and, more particularly, to fuze arrangements for a point detonating spin stabilized projectile.

It is an object of the invention to provide a graze sensitive and self destruct fuze arrangement for a point detonating spin stabilized projectile.

Another object of the invention is to provide such an arrangement that has a maximum of functional reliability.

A further object of the invention is to provide such an arrangement that can be assembled manually or in an automated assembly line.

These and other objects, features and advantages will become more apparent from the following description and accompanying drawings in which.

Figure 3:
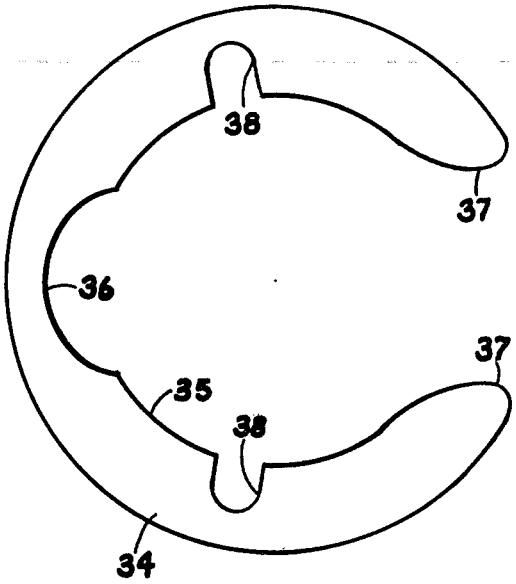
FIG. 3 is an enlarged top plan view of the expandable spring detent employed in the arrangement of FIGS. 1 and 2.

The point detonating spin stabilized projectile 11 (FIGS. 1, 2) has an internally threaded forward opening in which is secured the externally threaded rearward portion of substantially conically tapered nose member or fuze ogive 12 that is suitably recessed peripherally to securingly assemble a sealing nose cap 13. A firing pin 14 is longitudinally mounted in a central forwardmost passage of ogive 12 and has a laterally extending thin annular flange 15 securely assembled by the ogive annular crimp 16. The rearwardly opening cylindrical internal surface of the fuze ogive has a substantially hemispherical shaped forward base portion 17, a pair of longitudinally spaced sidewall annular grooves or ramps 18, 19 of predetermined trapezoidal configurations and a relatively deeper sidewall annular groove 20 therebetween, and a threaded rearmost portion 21 for a suitable assembled securement of explosive booster holder 22.

Figure 1:
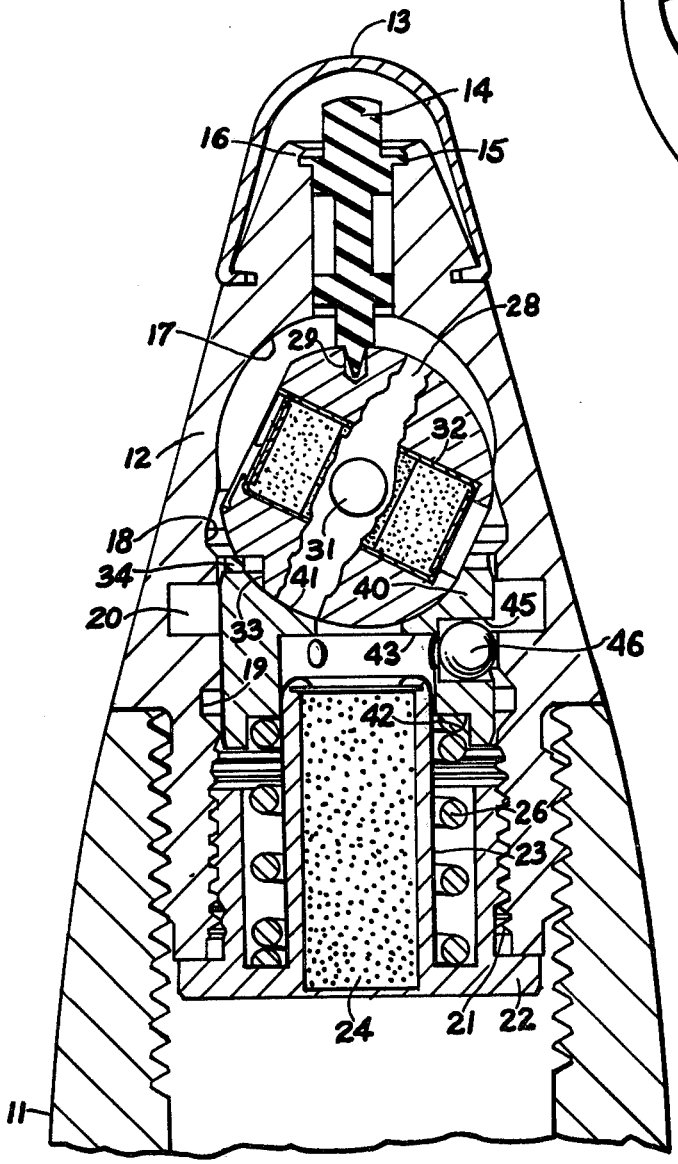
FIG. 1 is a substantially elevational sectional view of a preferred unarmed projectile fuze arrangement embodying the principles of the invention.
Figure 2:
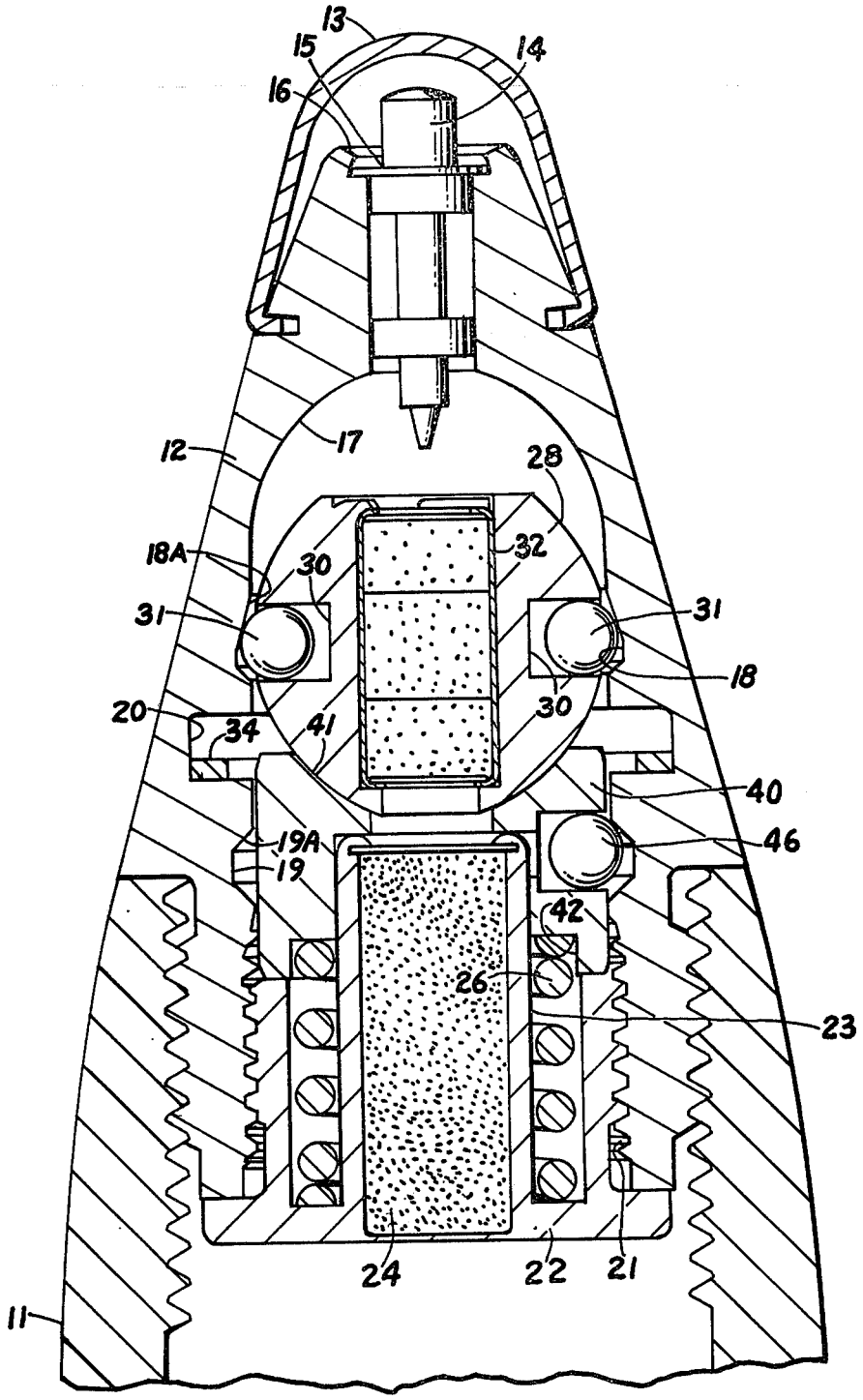
FIG. 2 is a longitudinal sectional view of the FIG. 1 arrangement in an armed condition.

Holder 22 has an elongated cylindrical portion 23 containing a central explosive booster charge 24 and a forwardly opening annular recess in which a slightly compressed helical spring 26 is seated in the FIG. 1 unarmed view. The unarmed ball rotor 28, initially secured in that condition with the tip of firing pin 14 engaged in the rotor forwardmost opening 29, has a pair of diametrically opposed peripheral recesses 30, 30 (FIG. 2) containing respective rotor detent balls 31, 31 that will align and engage with annular ramp or groove 18 upon launching and spinning of the projectile. The rotor carries a detonator 32, appropriately secured in a through passage extending along or centered on the rotor ball principal moment of inertia axis which is offset from recess 29, that will align with the firing pin tip and booster charge 24 when the rotor is moved to the armed position (FIG. 2) after being subjected to set back and centrifugal forces. Rotor 28 has a suitable peripheral recess 33 (FIG. 1), preferably C-shaped, that extends transversely of the unarmed rotor longitudinal axis through recess 29, for accommodation of expandable C-shaped spring detent 34 that initially serves to lock the rotor in the unarmed position before operationally moving partially and then fully into groove 20. The internal surface 35 of spring detent 34 has an arcuate recess 36 (FIG. 3), diametrically opposed to the spring opening defined by end portions 37, 37, and a pair of stress notches 38, 38 predeterminally dimensioned and located intermediate the arcuate recess 36 and corresponding ones of the spring end portions 37. A centrally apertured cylindrical rotor support 40, positioned between the rotor 28 and holder 22, has a concave annular or spherical seat 41 provided in its forward surface for journally receiving rotor 28. The rearward surface of rotor support 40 has stepped annular recesses 42, 43 that respectively accommodate the forward portions of compression spring 26 and the telescoping explosive holder portion so as to slightly bias rotor support 40 and rotor 28 forwardly in the unarmed FIG. 1 condition. Substantially mid-length of rotor support 40, its peripheral sidewall has a plurality (preferably 3) of circumferentially spaced recesses 45 each containing a corresponding self destruct detent ball 46 that will align and engage with annular ramp or groove 19 upon launching and spinning of the projectile.

During setback or projectile launch acceleration, the rotor assembly elements 28, 32, 34 and 31, as well as rotor support 40 and its balls 46 move rearwardly against the precompressed spring 26 until the rotor support bottoms or seats against holder 22, thereby releasing the firing pin from rotor recess 29 and aligning rotor detent balls 31 with ogive ramp or groove 18, self destruct dentent balls 46 with ogive ramp or groove 19, and rotor detent spring 34 with ogive groove 20. As the launched projectile spins up, centrifugal force causes radially outward movement of rotor detent balls 31 and self destruct detent balls 46 for respective engagement with the forwardmost inclined portions 18A, 19A (FIG. 2) of trapezoidal grooves 18 and 19, as biased thereagainst by the further compressed spring 26. The incline of ramp 19A is greater than that of ramp 18A to provide a relatively greater opposition force against spring 26. As the projectile spin rate increases, rotor detent spring 34 partially expands into groove 20 due to arcuate recess 36 (FIG. 3) to release the rotor 28 which is then free to rotate into the desired FIG. 2 arming alignment due to an imbalance of moments of inertia. As the projectile spin rate further increases, the rotor detent spring 34 continues to expand, due to the presence of stress notches 38 (FIG. 3), more fully into ogive groove 20, thereby assuring that the internal surface 35 of the C-shaped spring detent 34 will be clear of and not interfere with the forward motion of rotor support 40 during graze impact or self destruct functioning of the projectile fuze.

Should the projectile satisfactorily make nose or point impact with a target, nose cap 13 will crush and firing pin flange 15 will shear as the firing pin 14 is driven rearwardly into the aligned rotor detonator to ignite the explosive booster charge 24 and a projectile main charge (not shown). Should the projectile only graze impact soft ground media, a rearward component graze force upon the projectile will be sufficient to reactively move rotor detent balls 31 forward and inward along annular ramp portion 18A to unlock the armed rotor 28 as it is thus moved forward toward the firing pin to initiate the detonator.

Should the projectile made a graze impace with relatively hard ground media or only graze impact a target, a rearward component graze force upon the projectile will be sufficient to reactively enable spring 26 to move or cam self destruct balls 46 forward and inward along annular ramp portion 19A and rotor detent balls 31 similarly along ramp portion 18A to unlock both the rotor support 40 and rotor 28 as both are thus moved in unison toward the firing pin to initiate the detonator.

Should the projectile fail to be detonated in any of the foregoing ways, the resulting deceleration of its spin rate will ultimately reduce substantially the centrifugal force that had been acting upon the self destruct detent balls 46 and the forward force of spring 26 upon rotor support 40 will no longer be countered with a sufficient oppositional force to prevent the spring from moving or camming balls 46 inwardly as the spring rapidly drives the rotor support and rotor forward to thus move the detonator 32 into the firing pin for self destructive initiation of the explosive train.

Various modifications, changes or alterations may be resorted to without departing from the scope of the invention as defined by the appended claims.

I claim:

1. In a point detonating spin stabilized projectile having a fuze ogive secured in a forward portion of said projectile, a firing pin longitudinally mounted in a central forwardmost passage of said ogive, an explosive booster holder carrying a central booster charge and secured in a rearward portion of said ogive, and a rotor carrying a detonator and a plurality of peripheral rotor detent balls for rotatably mounting said rotor in said ogive intermediate said holder and said ogive passage, a tubular rotor support slidably mounted in said ogive intermediate said rotor and holder, said support carrying a plurality of self destruct detent balls in its peripheral surface, a compression spring carried by said holder and forwardly biasing said support, an expandable detent positioned between said rotor and rotor support and locking said rotor in an unarmed position, said fuze ogive having a pair of longitudinally spaced internal annular grooves for respectively receiving said rotor detent balls and self destruct detent balls upon launching and flight of said projectile, and a third ogive annular groove intermediate said spaced pair of annular grooves for reception of said expandable detent when the projectile attains predetermined rates of spin.

2. The structure in accordance with claim 1 wherein said expandable detent is a C-shaped spring.

3. The structure according to claim 2 wherein an internal surface of said C-shaped spring has an arcuate recess diametrically opposed to a spring opening defined by end portions thereof, and a pair of stress notches in said spring internal surface intermediate said arcuate recess and corresponding ones of said spring end portions.

* * * * *